US005369234A

United States Patent [19]

Demissy

[11] Patent Number: 5,369,234

[45] Date of Patent: Nov. 29, 1994

[54] PERPENDICULARLY-OPENING GROUNDING SECTION SWITCH

[75] Inventor: Daniel Demissy, Montreal, Canada

[73] Assignee: Gec Alsthom Energie Inc., Laprairie, Canada

[21] Appl. No.: 57,854

[22] Filed: May 7, 1993

[30] Foreign Application Priority Data

May 11, 1992 [FR] France ..... 92 05689

[51] Int. Cl.[5] ..... H01H 33/12; H01H 9/38

[52] U.S. Cl. ..... 200/146 R; 200/48 R

[58] Field of Search ..... 200/146 R, 146 A, 48 R, 200/48 A; H01H 33/12

[56] References Cited

U.S. PATENT DOCUMENTS 5,243,159 9/1993 Demissy ..... 200/146 R

FOREIGN PATENT DOCUMENTS 0120409 10/1984 European Pat. Off. .
0198506 10/1986 European Pat. Off. .
1964363 7/1970 Germany .

*Primary Examiner*—J. R. Scott
*Attorney, Agent, or Firm*—Sughrue, Mion, Zinn, Macpeak & Seas

[57] ABSTRACT

A perpendicularly-opening grounding section switch comprising a female contact and a male contact disposed at the end of the drive rod includes two parallel metal horns disposed in such a manner as to clamp against the end of the arm in the vicinity of the male contact when the section switch is in the closed position, and a flexible metal rod or whip which is constrained to slide along a fixed point of a guide piece while the arm is performing an opening operation, the respective lengths of the horns and of the whip being selected so that current is switched first to the horns and then to the whip during an opening operation.

2 Claims, 7 Drawing Sheets

PERPENDICULARLY-OPENING GROUNDING SECTION SWITCH

The present invention relates to a grounding section switch that opens perpendicularly, and that is provided with a mechanism enabling residual current to be interrupted suddenly during a switch-opening operation.

BACKGROUND OF THE INVENTION

It is known that high tension grounding section switches need to be provided with a degree of interrupting power in order to enable them to interrupt inductive or capacitive currents that may be induced by proximity to another line that runs parallel and is under load.

OBJECTS AND SUMMARY OF THE INVENTION

An object of the present invention is to define a section switch that is provided with a break mechanism imparting a degree of current-interrupting ability to the switch.

Another object of the invention is to implement a section switch that is capable, in operation both for opening purposes and for closing purposes, of breaking ice that may have formed on its contacts.

Another object of the invention is to implement a section switch provided with a mechanism that is robust, making it possible to perform a large number of current-interrupting operations reliably and repetitively, and which is cheap to implement.

The closest prior art is constituted by Document DE-A-1964363 which describes a section switch provided with an arcing contact constituted by a whip; implementing the whip requires a mechanism that is complex and that includes several moving parts, together with a brake for braking the movement of the whip at the end of an opening operation. Such a mechanism is complex and expensive, expensive to maintain, and incapable of operating when the section switch is covered in ice.

An object of the invention is to implement a whip section switch that operates safely, even when the section switch is covered in ice.

The present invention provides a perpendicularly-opening grounding section switch comprising a female contact disposed at the end of a metal support that is connected to a current terminal and that is fixed to the top of an insulating column, and a male contact disposed at the end of a drive arm actuated by a drive mechanism, said arm being connected to ground, the drive mechanism serving during a section switch opening operation initially to move the arm in translation along its own axis, and then to swing the arm through an angle of amplitude close to 90° , section switch including two metal horns fixed to said support and in electrical contact therewith, said horns being parallel and being disposed in such a manner as to clamp against the end of the arm in the vicinity of the male contact when the section switch is in its closed position, and a flexible metal rod or whip having one end fixed to a point of the arm and extending along said arm when the section switch is in its closed position, said whip being constrained to slide along a fixed point of a guide piece while the arm is performing an opening operation, the respective lengths of the horns and of the whip being chosen in such a manner that after the male and female contacts have separated during a switching operation, current is diverted firstly to the horns and subsequently to the whip, such that the whip is then sufficiently curved to provide good electrical contact when the arm looses contact with the horns.

Advantageously, the stationary guide piece is a metal rod fixed to said support and disposed perpendicularly to said arm when the section switch is in its closed position, said rod being provided with a barb, said fixed point being at the Junction between said rod and said barb.

BRIEF DESCRIPTION OF THE DRAWINGS

The invention is explained in detail in the following description of a particular embodiment, given with reference to the accompanying drawings, in which.

MORE DETAILED DESCRIPTION

Figure 1:
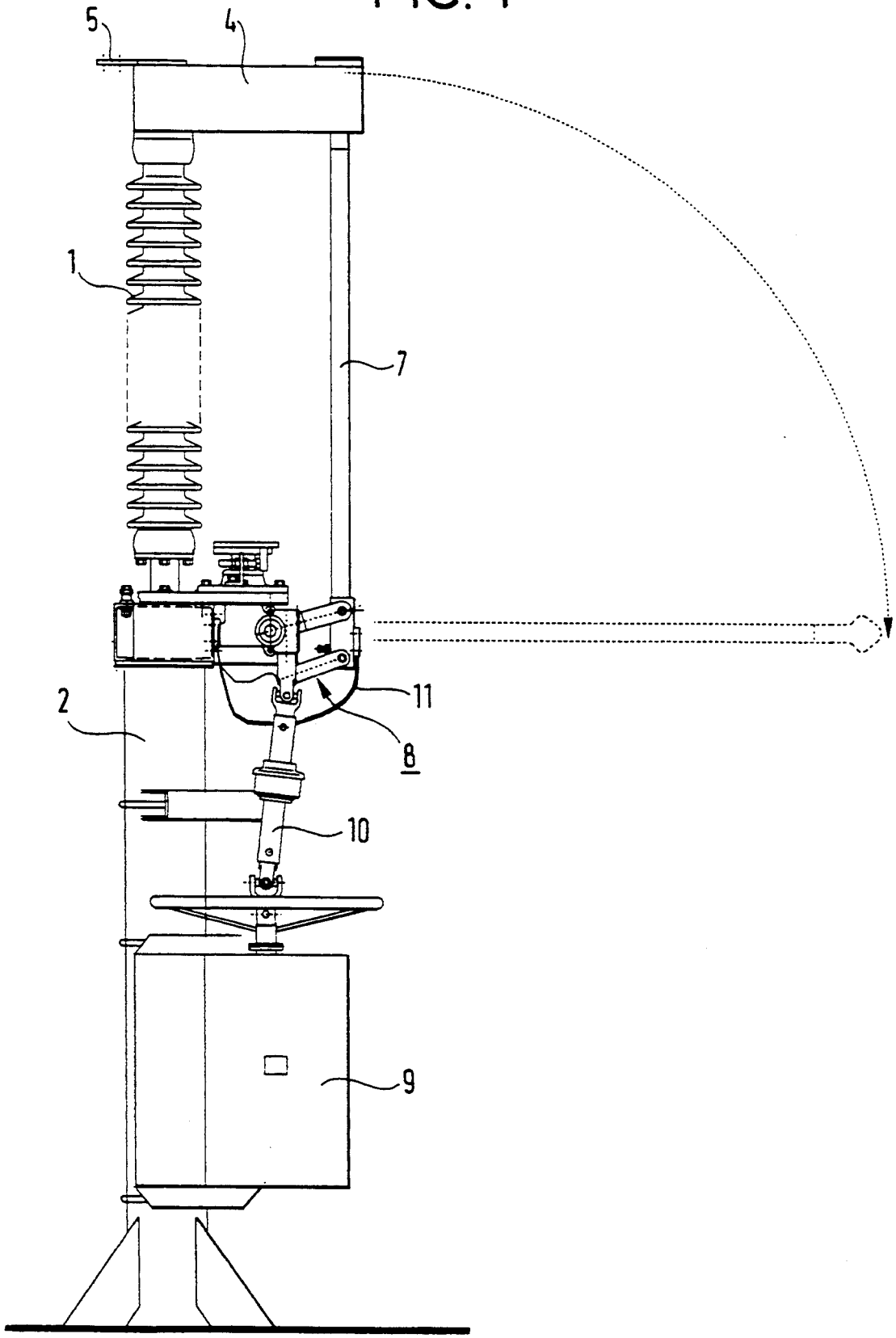
FIG. 1 is an elevation view of a perpendicularly-opening grounding section switch.
Figure 2:
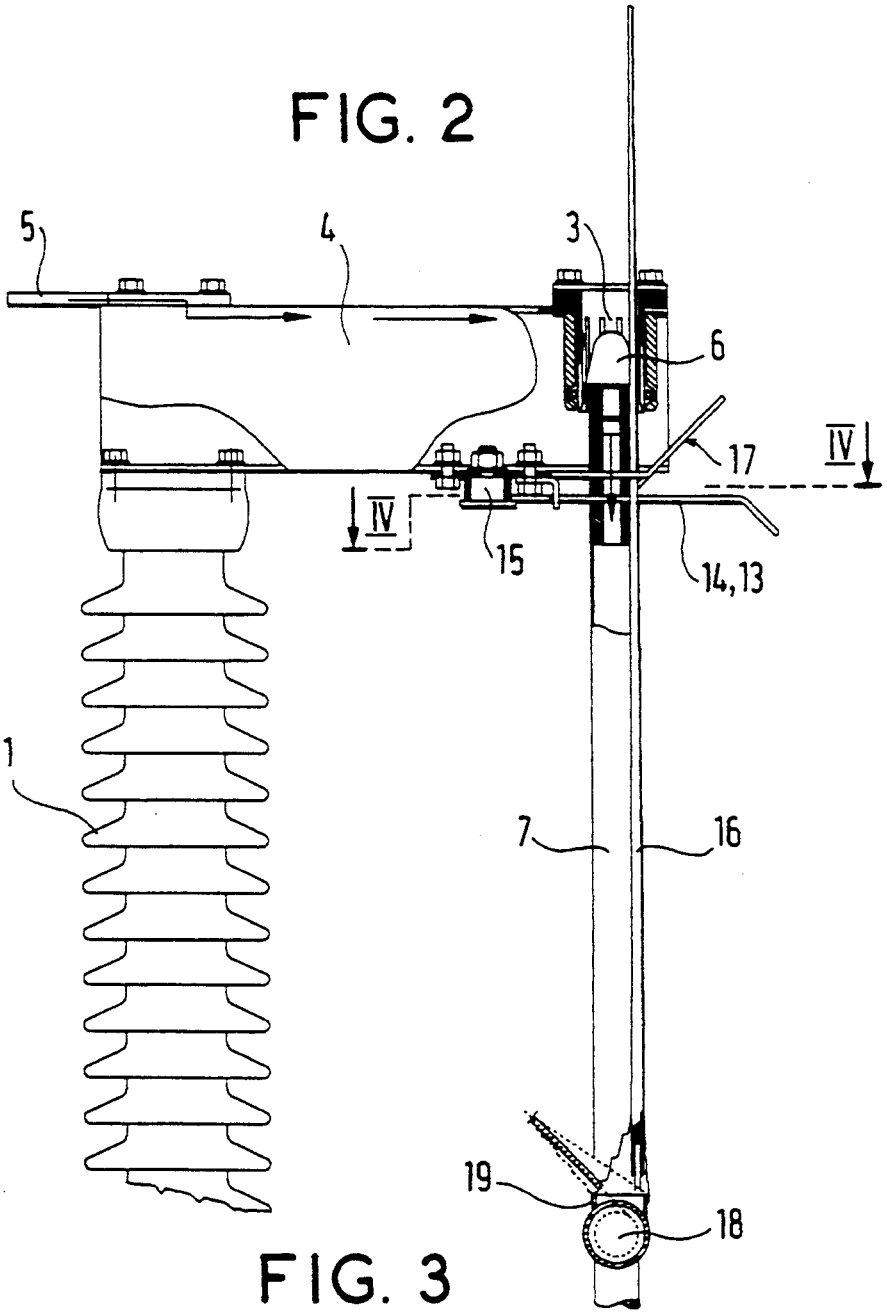
FIG. 2 is an elevation view partially in section of the top portion of the grounding section switch, shown in its engaged position.
Figure 3:
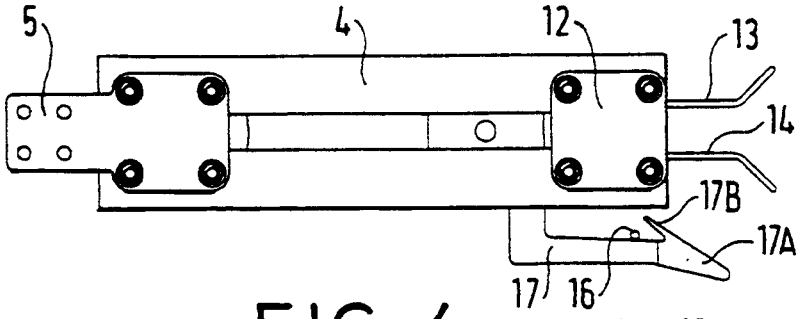
FIG. 3 is a plan view of the section switch in the position shown in FIG. 2.
Figure 4:
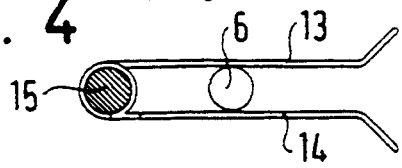
FIG. 4 is a fragmentary section view on line IV—IV of FIG. 2.

Reference is made to FIGS. 1 to 4 which show a grounding section switch of the type that opens perpendicularly, with the switch being shown in its closed position. It comprises an insulating column 1 placed on top of a metal stand 2 and carrying a female contact 3 at the end of a support 4 located at the top of the insulating column. The support 4 is made of metal and carries a current terminal 5.

Reference 6 designates a male contact, placed at the end of a drive arm 7 which is displaced by a section switch drive means including a mechanism 8 driven by a motor enclosed in a housing 9 and by a mechanical transmission shaft 10.

The female contact 3 is of the thimble type, i.e. it comprises a plurality of parallel fingers lying on a cylindrical surface. The female contact 3 is fixed to the support by a voltage plate 12. The male contact 6 has a swollen end portion 6A for co-operating with the female contact, thereby ensuring good contact 3 pressure. The other end of the arm 7 is connected to the stand 2 which is at ground potential by means of a metal braid 11.

During an opening operation the section switch drive mechanism means imparts motion to the arm 7 as follows: firstly vertical motion enabling the male and female contacts 6 and 3, respectively to be separated, and then rotary motion in a vertical plane until the drive arm 7 reaches a horizontal position as shown in dashed lines in FIG. 1.

As can be seen in FIGS. 2 to 5, the section switch carries two metal horns 13 and 14 which are fixed to the support 4 by means of a bolt 15 and which extend horizontally, in parallel. The gap between the horns 13 and 14 is such that they press hard enough against the male contact 6 to ensure that current passes, as described below. The ends of the horns 13 and 14 are curved to facilitate engaging the male contact 6 while closing the section switch.

A flexible metal rod 16, referred to as a "whip", is fixed to the arm 7, and when the section switch is in its closed position, the whip 16 extends along the arm 7. The length of the whip 16 is such as to cause it to project beyond the support 4. The whip 16 is guided by a guide piece 17 fixed to the support 4 and constituted by a metal rod disposed perpendicularly to the arm 7 when the section switch is in its closed position. The rod 17 has a portion 17A that slopes upwards and that is provided with a barb 17B. The whip 16 is fixed to the arm 7 by a bolt 18 which also carries a piece 19 that sets a limit on the slope that the whip 16 can take up relative to the arm 7. The bolt 18 provides electrical contact between the arm 7 and the whip 16. During a section switch opening operation, the guide piece 17 constrains the whip 16 to slide along a fixed point at the junction between the guide piece 17 and the barb 17B, thereby causing the whip 16 to bend to a greater or lesser extent.

The section switch operates as follows:

SECTION SWITCH OPENING

Prior to opening (FIG. 2) the male contact 6 has its swollen portion in contact with the fingers of female contact 3. Current flows through the terminal 5, the support 4, the contact fingers of female contact 3, the male contact 6, the arm 7, the braid 11, the stand 2, and ground.

Figure 5:
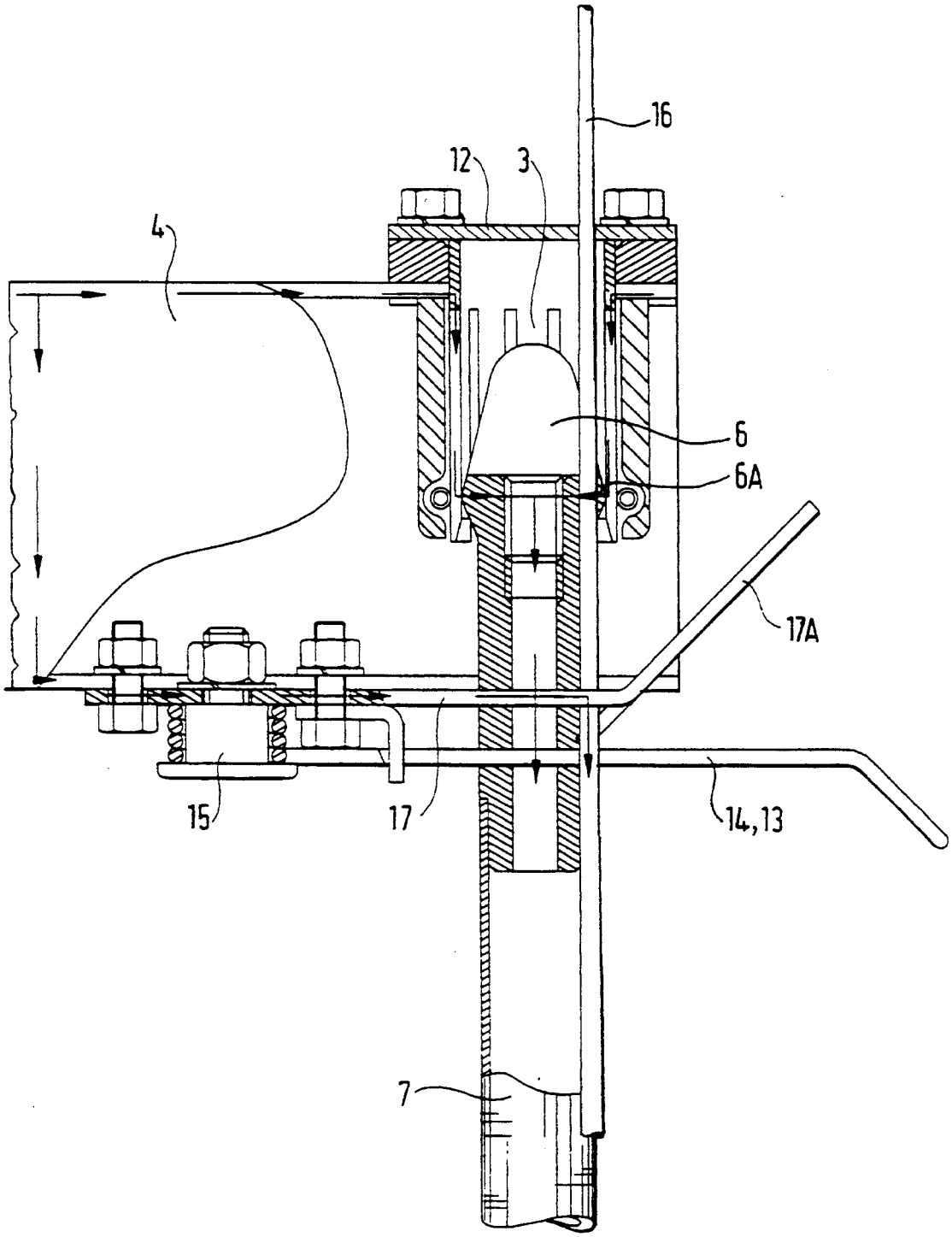
FIG. 5 is a view on a larger scale showing a portion of FIG. 2.

On opening, the male contact 6 leaves the female contact fingers 3 progressively so that current is progressively diverted via the horns 13 and 14 (FIG. 5). The whip 16 remains in position along the arm 7.

Figure 6:
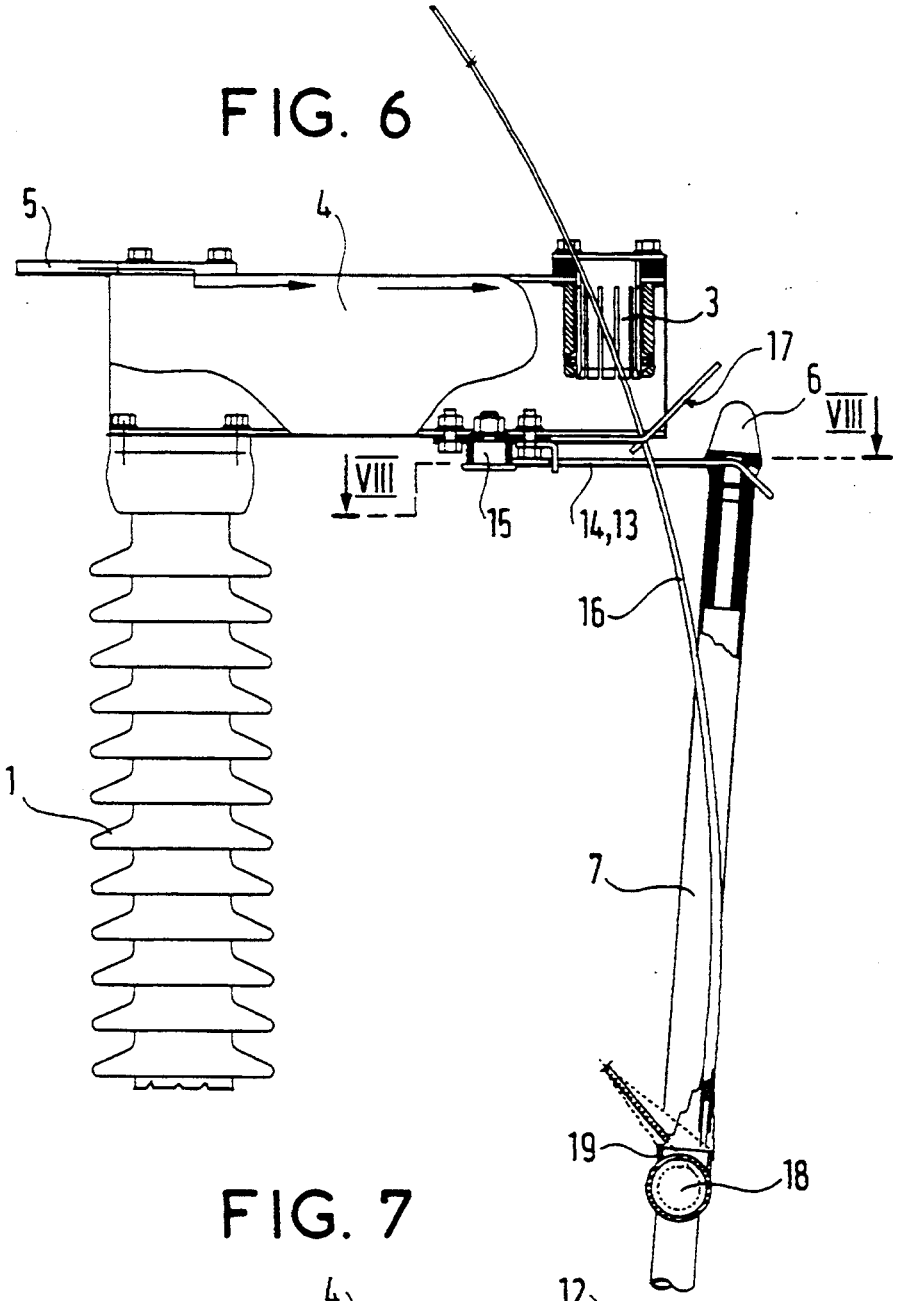
FIG. 6 is an elevation view, partially in section, showing the top portion of the section switch at the beginning of an opening operation.
Figure 7:
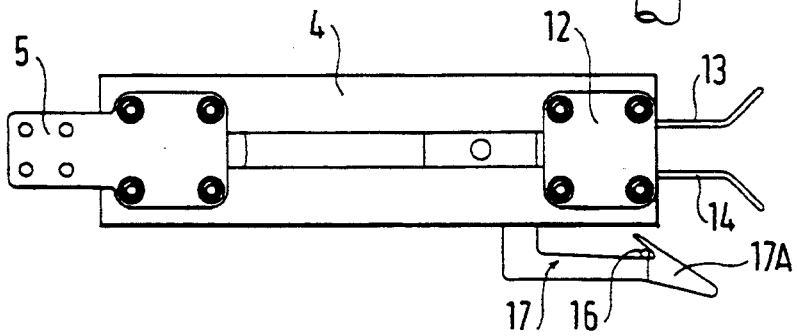
FIG. 7 is a plan view of the section switch in the position shown in FIG. 6.
Figure 8:
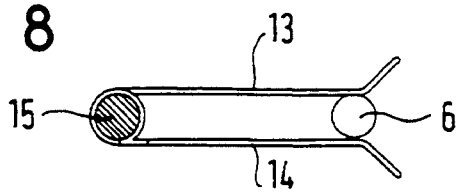
FIG. 8 is a section view on line VIII—VIII of FIG. 6.
Figure 9:
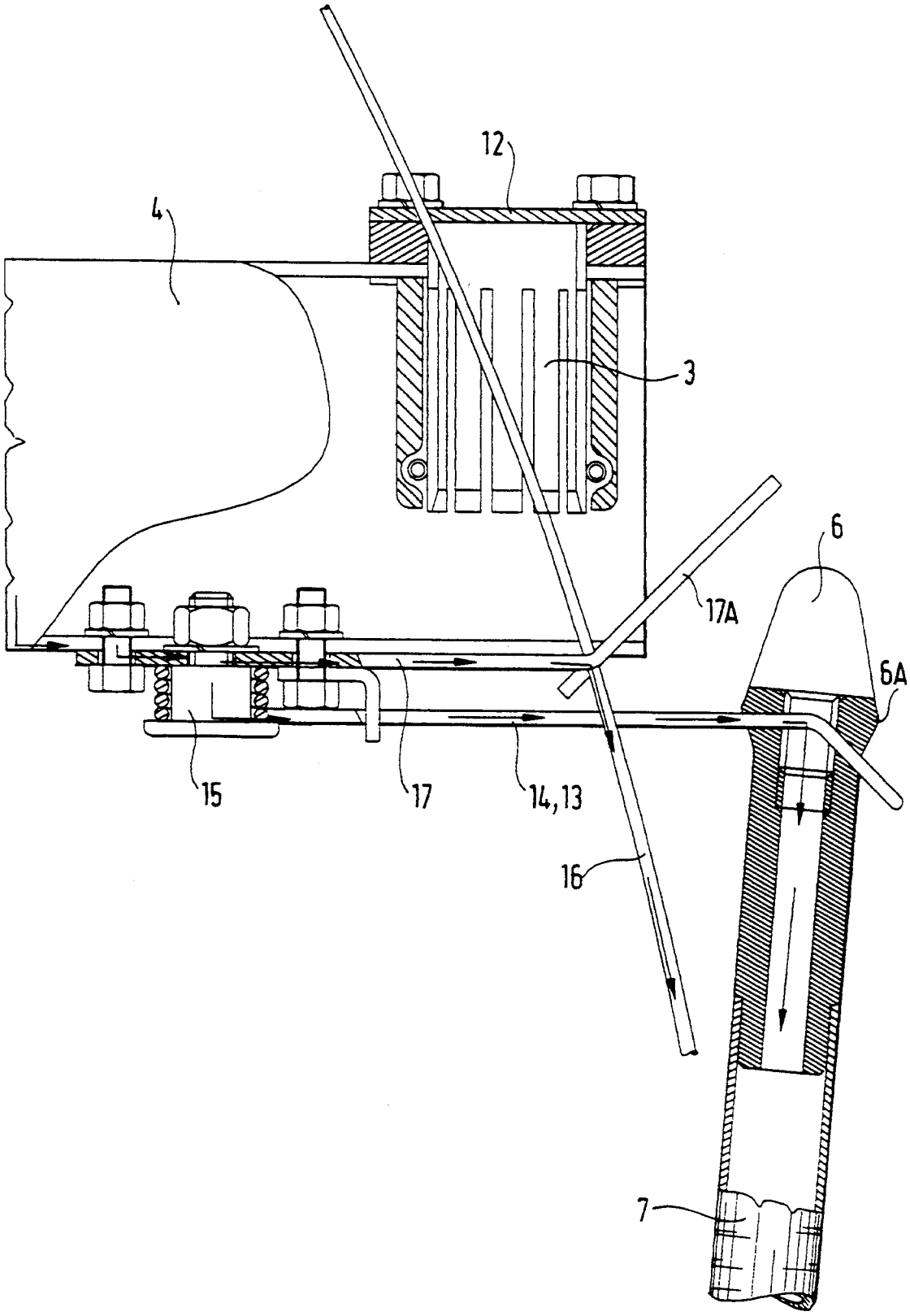
FIG. 9 is an enlarged view of a portion of FIG. 6.

After leaving the fingers of female contact 3, the male contact 6 moves away from the female contact 3 with the arm 7 pivoting in a vertical plane (FIG. 6). The current is shared between the whip 16 and the horns 13 and 14. The whip 16 is in good electrical contact with the guide piece 17 because of the pressure exerted by the curvature of the whip 16. The barb 17B guides the whip 16 so that it slides in the notch provided thereby.

Figure 10:
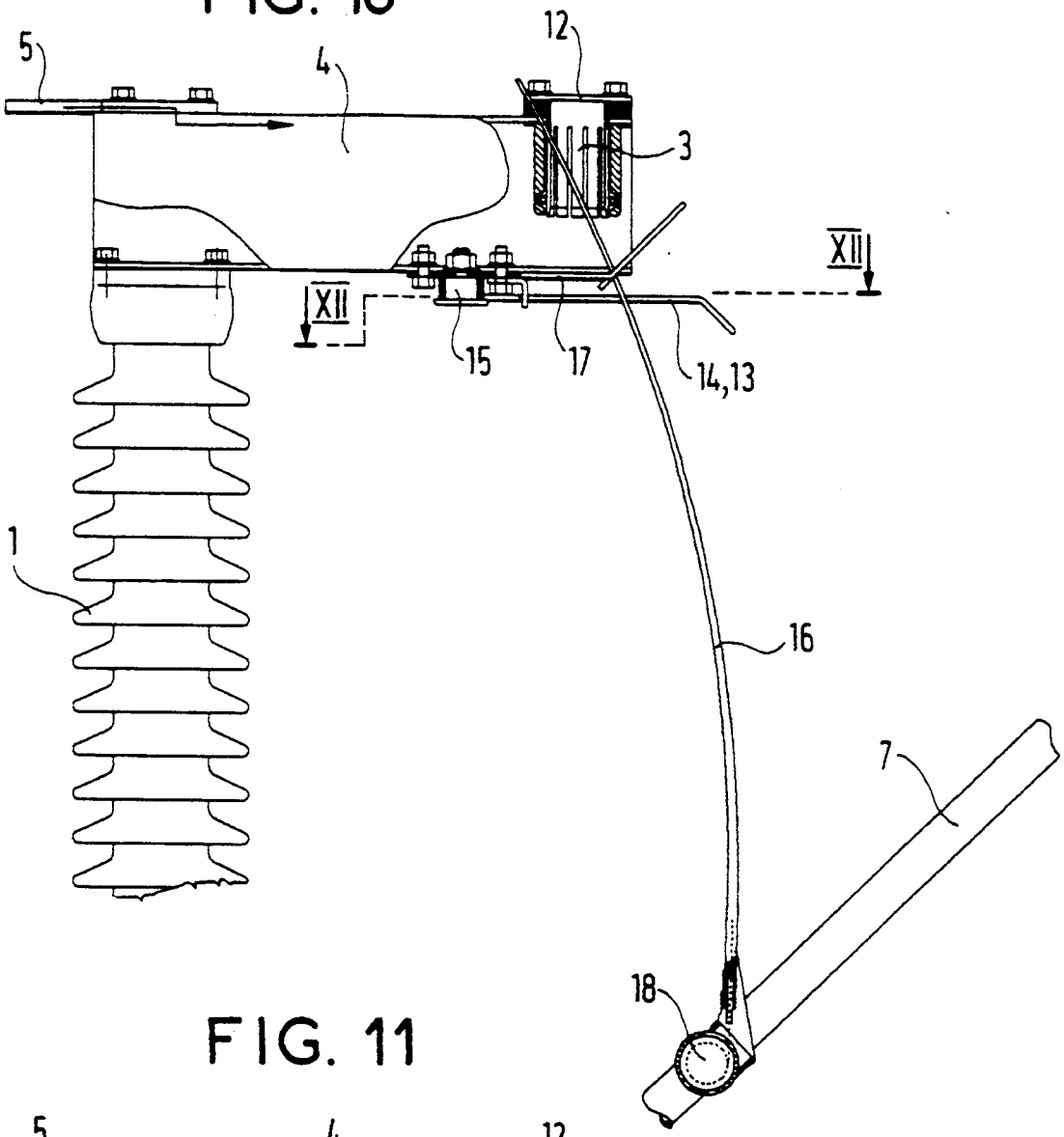
FIG. 10 is an elevation view of the top portion of the above section switch, shown about halfway through an opening operation.
Figure 11:
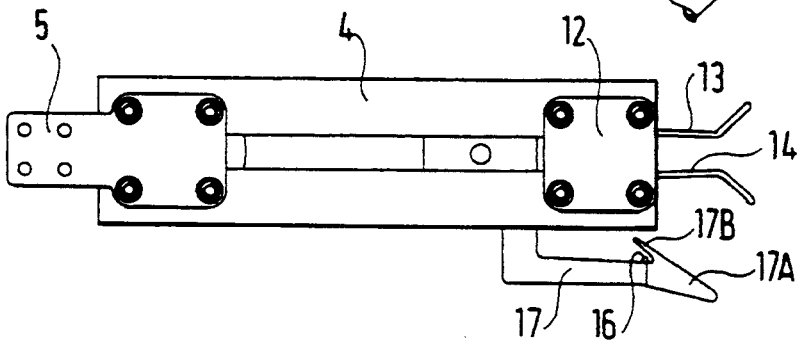
FIG. 11 is a plan view of the section switch in the position shown in FIG. 10.
Figure 12:
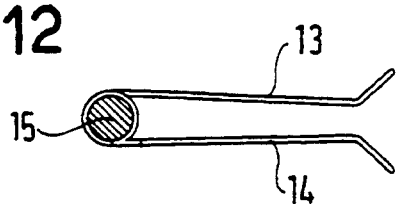
FIG. 12 is a section view on line XII—XII of FIG. 10.
Figure 13:
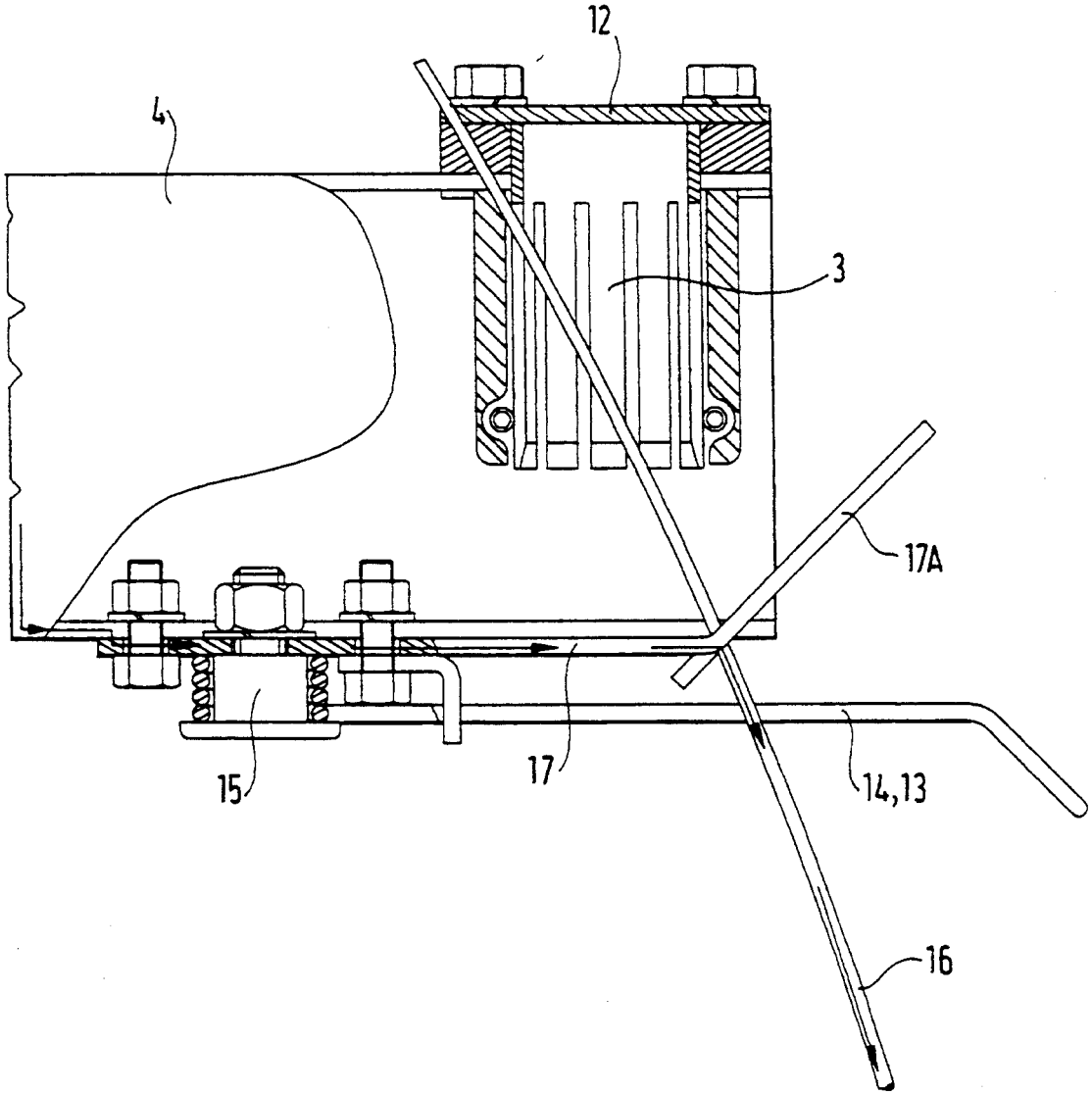
FIG. 13 is an enlarged view of a portion of FIG. 10.

When the male contact 6 leaves the horns 13 and 14, all of the current flows via the whip 16 whose curvature increases more and more (FIGS. 10 and 13). At the end of the stroke of the arm 7, the distance between the male contact 6 and the female contact 3 is at a maximum, thereby ensuring that re-striking is impossible, and it is at this point that the whip 16 escapes from the barb 17B. Because of its resilience, the whip 16 springs suddenly back towards the arm 7. The current is interrupted and there is no danger of an arc being re-struck since the insulation distance is achieved.

It may be observed that at the beginning of the opening operation, current is diverted via the horns 13 and 14. During this stage, the whip 16 curves. While the current is being diverted, first in part and then in full to the whip 16, the contact pressure between the whip 16 and the guide piece 17 is large: this contributes greatly to reducing the electrical wear of the whip and thereby increases the number of current-interrupting operations that may be performed before it is necessary to replace the whip 16 and the piece it presses against.

CLOSING THE SECTION SWITCH

The same movements are performed in the opposite direction. The male contact 6 returns initially to its position between the horns 13 and 14 prior to a final movement that causes it to be engaged between the fingers of female contact 3. The whip 16 remains adjacent to the arm 7 throughout the swinging operation and is engaged automatically by the barb 17B. The flared ends of the horns 13 and 14 facilitate engagement of the arm 7.

It may be observed that at the beginning of the opening operation of the section switch, the current that was initially passing via the female and male contacts 3 and 6, respectively is diverted to the arm 7 and the horns 13 and 14. While this movement is taking place, the whip 16 is being curved (as shown in FIG. 6) so prior to separation it is tensioned. The male contact 6 is at a considerable distance from the horns 13 and 14 when the whip 16 leaves the guide piece 17. It can thus be seen that the whip serves to protect the active portions of the section switch from the effects of burning due to the arc. The high pressure that is exerted between the whip 16 and the guide piece 17 is capable of breaking the ice that may have built up prior to an opening operation, thereby ensuring that current is properly diverted to the whip.

In addition, the horns 13 and 14 constitute a clamp that exerts enough pressure on the arm 7 to break any ice that may have formed thereon, and this may occur equally well during opening or during closing.

In addition, the horns 13, 14 serve to keep the guide piece 17 properly centered both during an opening operation and during a closing operation.

The invention is applicable to perpendicularly-opening high tension grounding section switches, regardless of whether they are disposed vertically as described above or horizontally.

I claim:

1. A perpendicularly-opening grounding section switch comprising:

an insulating column mounted on a stand;

a metal support fixed on a top portion of said insulating column and carrying a current terminal;

a female contact disposed at one end of said metal support;

a drive arm having a first end and a second end, said second end being electrically connected to the stand which is at ground potential;

a male contact disposed at said first end of said drive arm and for cooperating with said female contact;

section switch drive means for imparting an up and down motion to said drive arm and also for imparting a rotary motion to said drive arm so as to swing said drive arm through an angle of amplitude of approximately 90°, said drive arm being operative to move between a section switch closed position where said male contact and female contact are engaged and a section switch open position where said male contact and female contact are separated;

a pair of parallel metal horns fixed to said metal support and in electrical contact therewith, said metal horns being spaced apart by such a gap as to rigidly clamp against said first end of said drive arm in a vicinity of said male contact when said drive arm is in said section switch closed position;

a flexible metal whip having one end fixed at a position on said drive arm and extending along said drive arm when said drive arm is in said section switch closed position; and a stationary guide piece fixed to said metal support and defining a fixed point along which said whip is constrained to slide while said drive arm is being swung by said section switch drive means to said section switch open position where said male contact moves away from said female contact;

whereby when said male contact separates from said female contact as said drive arm is moved to said section switch open position, electrical current is diverted firstly to said pair of metal horns which remain in contact with said drive arm for a predetermined distance, and subsequently to said whip as said drive arm separates from said pair of metal horns, said whip remaining in electrical contact with said guide piece until a distance between said male contact and said female contact reaches a maximum.

2. A section switch according to claim 1, wherein the stationary guide piece comprises a metal rod fixed to said metal support and disposed perpendicularly to said drive arm when the section switch is in its closed position, said metal rod being provided with a barb, said fixed point being located at the junction between said metal rod and said barb.

* * * * *